United States Patent [19]

Taft

[11] 4,432,178

[45] Feb. 21, 1984

[54] COMPOSITE STEEL AND CONCRETE FLOOR CONSTRUCTION

[75] Inventor: Buckie A. Taft, Bellevue, Wash.

[73] Assignee: Steel Research Incorporated, Bellevue, Wash.

[21] Appl. No.: 383,530

[22] Filed: Jun. 1, 1982

[51] Int. Cl.[3] ..... E04B 5/16

[52] U.S. Cl. ..... 52/334

[58] Field of Search ..... 52/334–337, 52/319, 720, 692, 321, 690, 693, 333

[56] References Cited

U.S. PATENT DOCUMENTS

| | | | |
|---|---|---|---|
| 1,926,182 | 9/1933 | Sereff | 52/321 |
| 3,147,571 | 9/1964 | Welch | 52/335 |
| 3,336,718 | 8/1967 | Cape | 52/692 X |
| 3,683,580 | 8/1972 | McManus | 52/336 X |
| 3,728,835 | 4/1973 | McManus | 52/334 |
| 3,818,083 | 6/1974 | Butts et al. | 52/334 X |
| 3,845,594 | 11/1974 | Butts et al. | 52/334 X |
| 3,945,168 | 3/1976 | Butts et al. | 52/319 X |
| 3,979,868 | 9/1976 | Butts et al. | 52/334 |
| 4,056,908 | 11/1977 | McManus | 52/335 X |
| 4,151,694 | 5/1979 | Sriberg et al. | 52/335 X |
| 4,259,822 | 4/1981 | McManus | 52/336 X |
| 4,295,310 | 10/1981 | McManus | 52/334 |

*Primary Examiner*—J. Karl Bell

*Attorney, Agent, or Firm*—Cole, Jensen & Puntigam

[57] ABSTRACT

A steel primary framing member, or truss, and concrete floor structure in which the top chord of the truss, regardless of cross-sectional configuration, is totally or at least partially embedded in the concrete to cause the concrete floor and steel truss to function together structurally as a composite system. The upper chord of the truss acts as a continuous or substantially continuous shear connector thus enabling the top chord to perform a multi-purpose function. Additionally, the top chord may be of any configuration and may be either a solid piece or contain perforations.

9 Claims, 8 Drawing Figures

COMPOSITE STEEL AND CONCRETE FLOOR CONSTRUCTION

BACKGROUND OF THE INVENTION

The invention relates generally to the area of open web steel framing and concrete floor buildings and more particularly to a primary steel framing member, in the form of a truss, in which the top chord acts as the shear connector in a composite system.

Composite design has been used in the construction industry for many years. The development and sophistication of economic structural systems gradually extended to steel buildings and concrete floor construction, the result of which was to significantly reduce cost of steel framing in the industry. However, composite construction was confined to primary wide flange or solid section members with stud-type shear connectors welded onto the top flanges in the field, and secondary framing members such as joists or beams, but not to primary trusses.

As those skilled in the industry are aware, conventional composite design consists essentially of three elements; that is, concrete, a steel beam or joist and a shear transfer mechanism. In the past, the shear transfer mechanism has usually been a stud shear-connector welded to the top flange of the beam and then the stud was encased in the concrete. Obviously, the shear-connecting device or stud, properly welded to the top flange of the beam, must be capable of developing the necessary shear force between the stud on the beam and the concrete to produce the desired composite action.

It will be appreciated that the purposes of composite floor construction are to save considerable steel weight and cost, as well as to reduce vibration and deflection. Concrete conventionally has not been intrinsically tied to the upper chord of a truss and thus the entire vertical primary member loading is taken by the steel truss alone. As stated above, it was for this reason that stud-type shear connectors were welded to the upper chord of a steel girder or beam, but shop-applied studs are costly and hazardous and generally objected to or rejected by labor unions and disallowed by safety regulations for those reasons. While composite construction has been used with joists, as evidenced in some of the patents identified below, the composite theory has not as stated above, been applied to trusses.

Among the prior-art patents which are considered to be of interest with respect to the instant invention are several which are owned by Hambro Structural Systems Ltd. of Ottawa, Canada. Those patent numbers are: U.S. Pat. Nos. 3,913,296; 3,845,594; 3,841,597; 3,979,868; and 3,818,083. The patents just cited are directed to secondary member composite floor construction as opposed to the instant invention in which a primary open-web framing member is one of the elements in a composite floor construction.

SUMMARY OF THE INVENTION

The invention comprises intrinsically the use of the top chord of a primary framing member or truss as a continuous or substantially continuous shear connector in composite construction. The concrete may be thickened at the truss line in order to increase the load-carrying capacity of the embedded top chord. The concrete may then gradually be reduced in thickness either close to or at a predetermined distance from the chord to a thickness dictated by the design requirements, as for example 3 inches. Additionally, the top chord supports joists in conventional fashion.

Accordingly, it is among the many features of the invention to use the top chord of the truss in a multi-purpose function. First, it supports the secondary framing members of joists, secondly, it acts as a conventional top chord to support construction loads, and thirdly, it is a continuous, or substantially continuous, shear connector in the composite stage. Because of the composite or multi-purpose design, the truss depth can be considerably less than it would be in the non-composite stage and thus decreases the weight of primary framing members. Because floor stiffness is increased by composite action, vibration and deflection are reduced substantially since there is a higher moment of inertia in the composite stage. Also, because of this design, it is only necessary to know the centerline distance between trusses to enable much faster calculation of joist dimensions which can improve delivery schedules, another factor in saving of costs. The design of this invention functions well with existing and known joist systems. It is estimated that the design will save in the range of 18–40 percent of primary truss weights, depending on various design criteria applicable.

DESCRIPTION OF PREFERRED EMBODIMENTS

Figure 2:
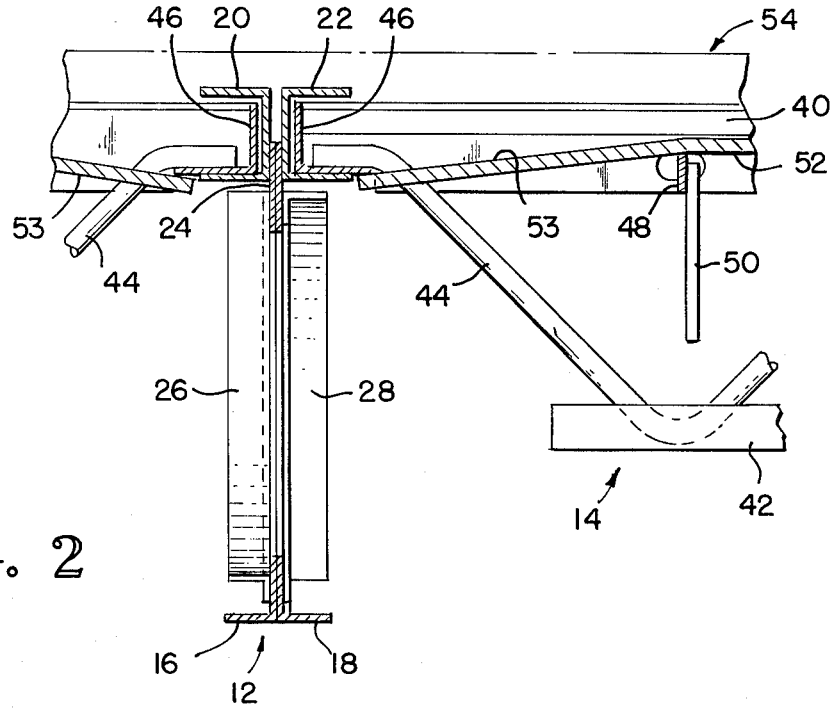
FIG. 2 is a cross-sectional view taken along the line 2—2 of FIG. 1 showing details of the truss and concrete composite system.
Figure 1:
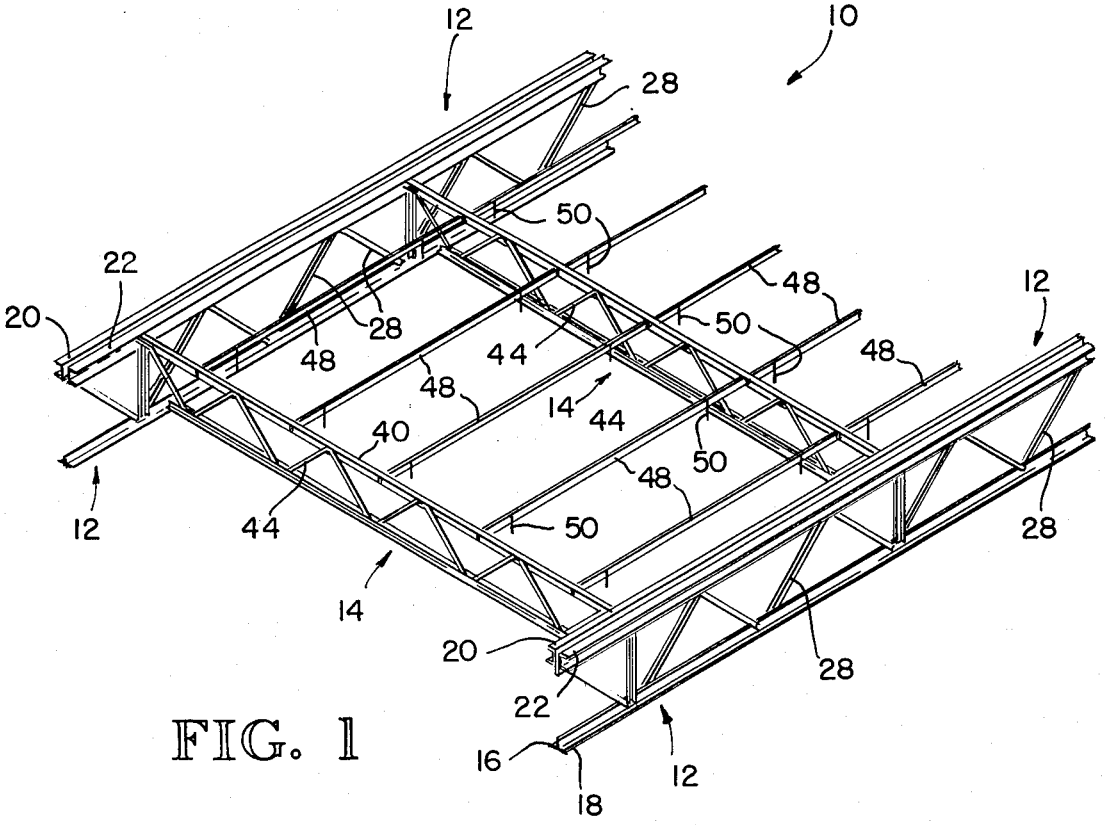
FIG. 1 is a partial isometric view showing some parts broken away to illustrate details of a preferred embodiment of the invention.
Figure 6:
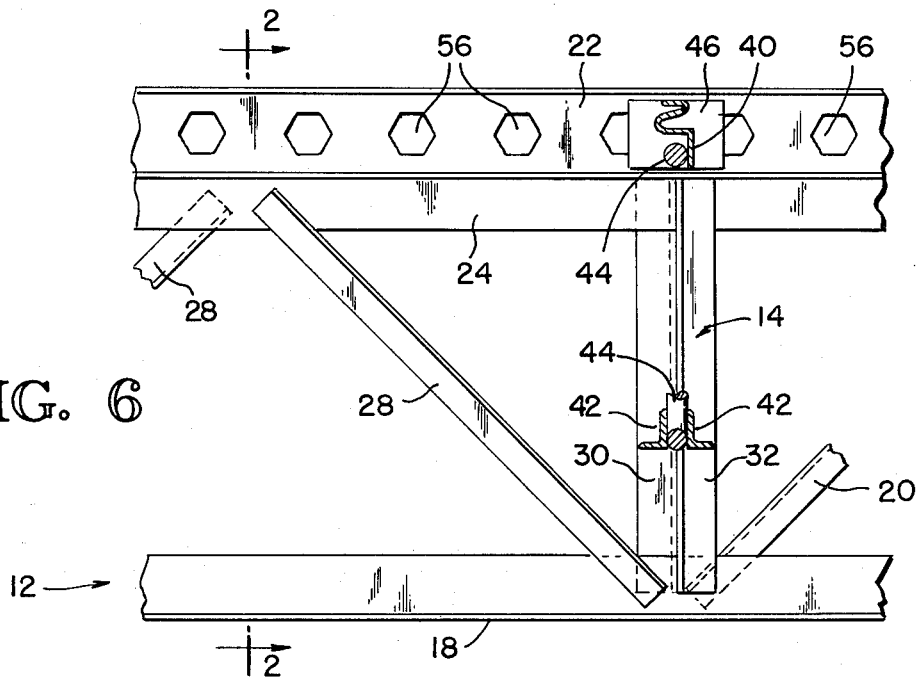
FIG. 6 is a partial cross-sectional view of the top chord of a composite joist as supported by the top chord of the truss of FIGS. 1 and 2.

It will be seen by reference to FIGS. 1, 2 and 6 that the framing structure, generally designated by the number 10 as in FIG. 1, is comprised of primary framing members or trusses 12 and secondary framing members or joists 14 which are supported at each end by the trusses 12. In this instance, the trusses have a bottom chord comprised of two abutting or separated angle members 16 and 18 and a top chord comprised of two channel members 20 and 22 which are spaced apart at the vertical leg with the horizontal legs thereof facing away from each other. A continuous gusset connection plate 24 is secured to channels 20 and 22 between their webs and extends below the lower flanges of the channels as shown in FIG. 2.

Figure 4:
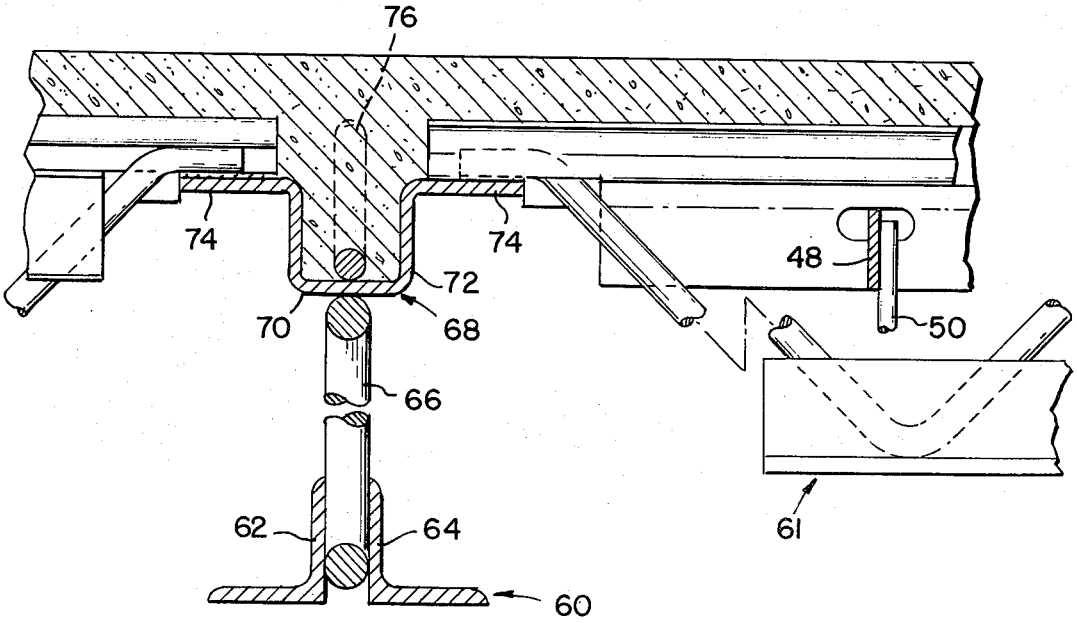
FIG. 4 is a cross-sectional view taken along the line 4—4 of FIG. 3 illustrating additional details of the second embodiment.
Figure 5:
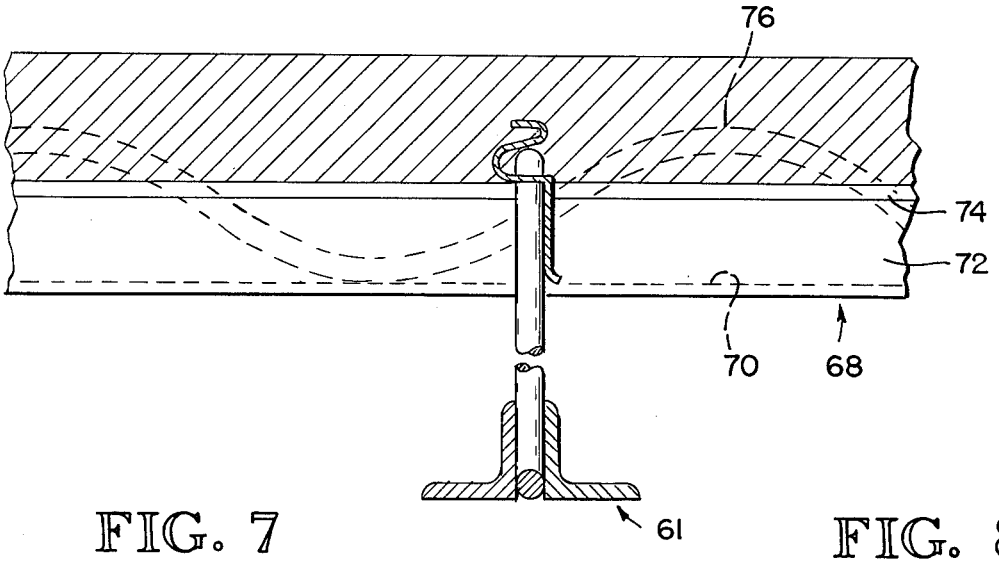
FIG. 5 is a partial cross-sectional view taken along the line 5—5 of FIG. 3 showing additional details.

While the web of the top chord of the truss 20 and 22 may be solid or perforated, it will be appreciated that the perforated top chord web may be of welded straight channel members as shown in FIGS. 1, 2 and 6, or the top chord may be a sine-wave type bar, supported by a hat section as shown in FIGS. 4 and 5 or by any other member. The continuous gusset connection plate 24 supports the angle members 26 and 28 which are secured as by welding to the connection plate 24 and to the abutting legs of the bottom chord angle pieces 16 and 18. A series of angle members 26 and 28 are secured as by welding to the connection plate 24 of the upper chord and to the abutting legs of the angle members 16 and 18 which comprise the bottom chord. It will also be appreciated that angle members 30 and 32 extend generally vertically on each side of the gusset plate 24 and the legs of bottom chord 16 and 18 at locations at which joists 14 will be supported as is shown particularly in FIG. 6.

The joist secondary framing member 14 has an upper chord 40 and a lower chord 42 with an open web bar 44 extending between the shoe 46 where it is solidly connected and the bottom chord 42. Note that the end shoe 46 is supported on the lower flange of channel members 22 and 20. In the one example, the joists, made according to the invention described in prior art patents above, have roll bars 48 with handles 50 for supporting plywood forms 52 for the concrete floor which is to be poured when the framing members and the forms are in place at the construction site.

The plywood form member 52 extends to the lower flange of the truss top chord, and the plywood form as at 53 extends outwardly at an angle until the distance between the top surface of the form 52 and the poured concrete 54 surface is as designed by the structural engineer. The form section 53 is shown to be a slight angle extending from the lower flange of the top chord of the truss to the top of the roll bar 48. The distance over which the angle portion 53 extends may vary according to design specifications.

Of importance is the fact that once the primary framing member 12 and the secondary framing members are in place, the concrete is poured to embed the two chord members 20 and 22 in the concrete so that the top chord becomes a continuous, or substantially continuous, shear connector in a composite truss and concrete floor system. Structural engineers are aware that a composite truss will have considerably greater stiffness than a non-composite truss of equal depth, loads, and span length. Additionally, deflection of composite trusses will usually be about $\frac{1}{2}$ to $\frac{2}{3}$ of the deflection of non-composite trusses. The composite system also reduces floor vibration. It will be noted in FIG. 6 that spaced openings 56 are formed in the webs of channel members 20 and 22 to mechanically increase the composite action. Utilizing the top chord of the truss in a multi-function role, that is, as a support for secondary framing members, as a conventional top chord to support construction loads, and as a continuous or substantially continuous shear connector in the composite stage, represents a new concept in steel framing and composite concrete floor construction. The concept of using the top chord of the primary framing member in this multi-purpose way is totally new and novel in the construction industry.

Figure 3:
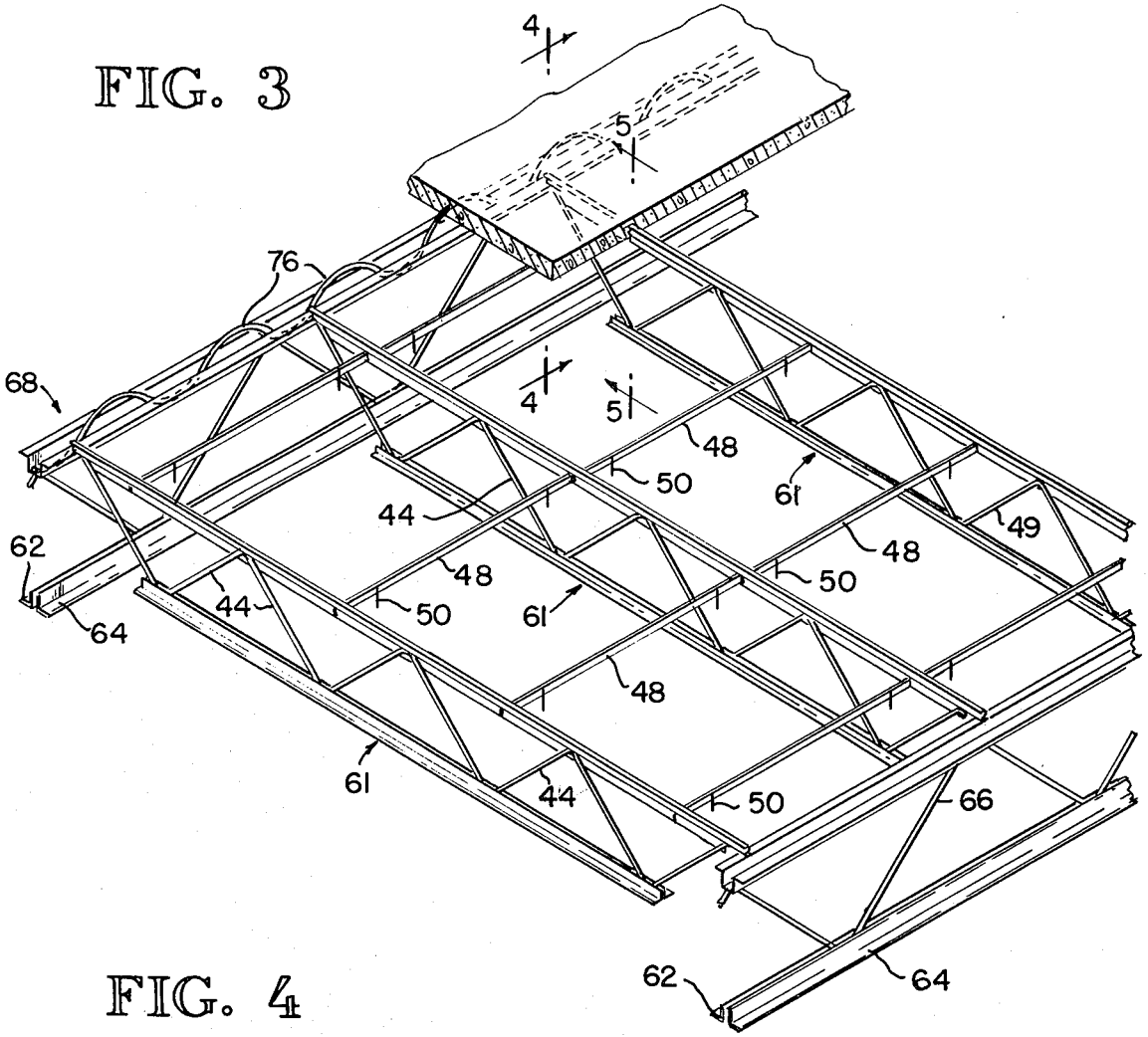
FIG. 3 is an isometric view illustrating details of a second embodiment of the invention.

FIGS. 3 and 4 show an alternative composite system design utilizing trusses 60 with conventional Hambro (registered trademark) joists as described above. In this embodiment of the invention, truss member 60 has lower angle members 62 and 64 in which the vertical legs are spaced apart to accommodate the serpentine or sine-wave web member 66. At the upper end is a U-shaped channel member 68 acting as the top chord having horizontal web 70, vertical sides 72 and horizontal flanges 74. In effect, it is a channel member with horizontally extending side flanges on which the ends of joists 61 will be supported. The channel faces upwardly as shown in FIG. 4 so that a sine-wave or serpentine type shear connector 76 is welded to the inside surface of the web 70. It extends for the full length of the top chord 68 to define a substantially continuous shear connector. The concrete when poured embeds the shear connector and may be thickest at the truss line.

Figure 7:
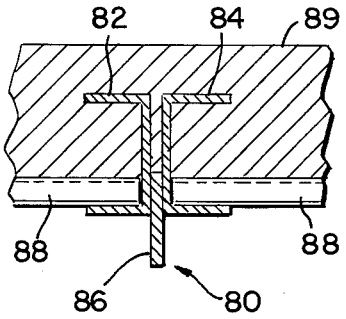
FIG. 7 is a partial cross-sectional elevation view showing details of a long span deck in a medium depth top chord.

FIG. 7 shows a relatively deeper top chord 80 with channel members 82 and 84 and gusset plate 86 where the truss is used with a long span deck 88 on the top of which is poured concrete to the level 89. Again, this embodiment shows use of the top chord of the truss in its multi-function role including that of a continuous shear connector.

Figure 8:
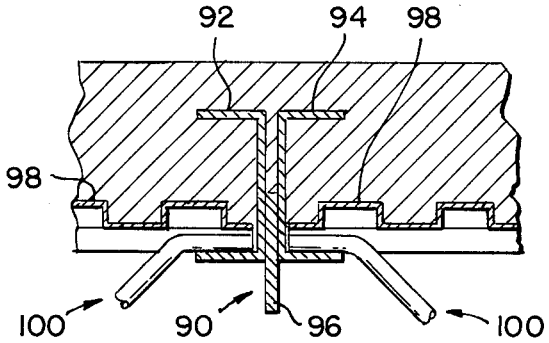
FIG. 8 shows the invention as applied to a deep web top chord of the truss with conventional joist and deck construction.

In FIG. 8, a deeper truss top chord 90 has channel members 92 and 94 and web extension 96. In this embodiment, a ribbed deck 98 is supported by a conventional joist structure 100 in which truss top chord 92 and 94 again becomes a continuous shear connector in addition to its other functions.

What is claimed is:

1. In a composite steel truss and concrete floor construction having primary steel open web truss framing members, secondary joist framing members supported at their ends on said truss framing members, and a concrete slab, the improvements comprising:

(a) a top chord means for said primary open web truss framing members including generally horizontally disposed support means for supporting the ends of said secondary framing members, (b) bottom chord means for said primary open web truss framing members and web means structurally interconnecting said top and bottom chord means; and (c) said concrete slab means being formed so as to extend from a level above the uppermost point of said top chord to a level below the uppermost point of said top chord so as to at least partially embed said top chord means in said concrete and thereby causing said top chord means to function as a continuous shear transfer connector means in said composite floor construction.

2. The composite steel and concrete floor construction according to claim 1 and in which said support means is a substantially continuous flange means and wherein said top chord means is substantially embedded in said concrete along substantially its entire length.

3. The composite steel and concrete floor construction of claim 1 and in which said concrete slab means substantially embeds all of said top chord so that the concrete is of greater thickness at a truss line than at a distance from a truss line.

4. The composite steel and concrete floor construction of claim 3 and wherein said greater thickness of said concrete slab means at a truss line extends upwardly and away from a truss line at a predetermined angle.

5. The composite steel truss and concrete floor construction of claim 1 and in which said top chord means includes two spaced apart members having at least one flange each extending horizontally outwardly and said members being secured to a continuous gusset connection plate between them.

6. The composite steel truss and concrete floor construction of claim 1 and in which said top chord means includes two spaced apart channel members having upper and lower flanges extending horizontally outwardly and said channel members being secured to one of the two means consisting of (1) a substantially continuous gusset connection plate between them and (2) any other means of transferring horizontal shear from the top chord in either the construction or service stage into the web means and bottom chord.

7. The composite steel truss and concrete floor construction of claim 6 and wherein said concrete slab means extends from above the upper flanges to a point near the lower flanges.

8. The composite steel truss and concrete floor construction of claim 5 and wherein said gusset connection plate is secured to and extends from between said spaced apart members to a predetermined distance below said spaced apart members.

9. The composite steel truss and concrete floor construction of claim 6 and wherein said gusset connection plate is secured to and extends from between said spaced apart members to a predetermined distance below said spaced apart members.

* * * * *